United States Patent [19]

Slattery et al.

[11] 4,391,115

[45] Jul. 5, 1983

[54] METHOD AND APPARATUS FOR BENDING METAL BEAMS

[75] Inventors: William Slattery, Annbank Station; Thomas Brechany, Ayr; Colin J. MacLeod, Glasgow, all of Scotland

[73] Assignee: Caledonian Mining Company Limited, Nottinghamshire, England

[21] Appl. No.: 212,594

[22] Filed: Dec. 3, 1980

[30] Foreign Application Priority Data

Dec. 4, 1979 [GB] United Kingdom ..... 7941886

[51] Int. Cl.[3] ..... B21D 7/04; B21D 43/28

[52] U.S. Cl. ..... 72/131; 72/152; 72/294; 72/305

[58] Field of Search ..... 72/129, 131, 149, 151, 72/152, 294, 295, 305, 306, 311, 702

[56] References Cited

U.S. PATENT DOCUMENTS

| | | | |
|---|---|---|---|
| 1,997,098 | 4/1935 | Beegle | 72/151 X |
| 2,411,801 | 11/1946 | Nielsen et al. | 72/151 X |
| 3,178,922 | 4/1965 | Tabor | 72/152 |
| 3,339,391 | 9/1967 | Kowalski | 72/151 |

FOREIGN PATENT DOCUMENTS

| | | | |
|---|---|---|---|
| 203977 | 9/1923 | United Kingdom . | |
| 462634 | 3/1937 | United Kingdom | 72/151 |
| 530348 | 12/1940 | United Kingdom . | |
| 615367 | 1/1949 | United Kingdom . | |
| 623096 | 5/1949 | United Kingdom . | |
| 863481 | 3/1961 | United Kingdom . | |
| 892896 | 4/1962 | United Kingdom . | |
| 987148 | 3/1965 | United Kingdom . | |

*Primary Examiner*—Ervin M. Combs

*Attorney, Agent, or Firm*—Wood, Herron & Evans

[57] ABSTRACT

The invention relates to arches for use in tunnels such as underground mine tunnels. These arches are composed of a bent metal beam often of "H" or "T"-section. Problems have previously arisen in accurately bending the beams to the required shape. The apparatus of the invention includes a D-shaped former which is rotatable relative to a roller. The beam is clamped to one end of the former and on rotation of the former relative to the roller, the beam is bent around the former so that it assumes the required shape, the ends of the beam being clamped to the former. A cutting device may be employed to cut the beam, while bent around the former, into three or more sections.

21 Claims, 4 Drawing Figures

METHOD AND APPARATUS FOR BENDING METAL BEAMS

This invention relates to arches for use in lining tunnels such as underground mine tunnels and for use in framework for covered structures above ground.

Mine tunnels often have metal "H" or "T"-beams which are curved to the shape of the mine walls and roof and which are formed in sections to be joined end to end (for example by fish-plates) to form an arch. Panelling then extends along the tunnel between successive arches to line the tunnel.

Problems have arisen in the formation of the curved "H" or "T"-beams in that it is very desirable for the curve to be both "set" and relatively exact so that when the arch sections are installed in a tunnel it is not necessary to contend with "spring-back" or misalignment of the arch sections. With presently known methods of bending "H" and "T"-section beams this has been difficult to achieve automatically and has relied on the manual skill of the manufacturers to produce accurately curved "H" and "T" beams by bending lengths of the beam around a stationary former.

The general object of the invention is to obviate or mitigate these problems.

A method of forming an arch or arch section from an elongate linear metal beam in accordance with the invention comprises clamping one end of the beam to one end of a rotatable D-shaped former having a convex arcuate edge and rotating the former relative to a roller so that the beam is caused by engagement between the roller and the former to be formed or bent around the arcuate edge of the former.

The invention can be used with, for example, "H" or "T"-section beams.

Apparatus in accordance with the invention for carrying out the method in accordance with the invention comprises a D-shaped rotatable former having a convex arcuate edge and a roller mounted on an axle fixed to a platform or a base relative to which the former may move angularly, means being provided for causing relative movement between the former and the roller about the centre of the arcuate edge portion of the former.

Preferably one or more cutting devices is provided above and movable with the rotatable former so as to be able to cut a beam bent around the former, into two or more sections. These sections can then more easily be transported into and assembled within the mine tunnel and connected together by fish-plates or the like.

Clamps which may conveniently be hydraulic clamps are preferably provided to clamp the ends of the beam to be bent to each end of the rotatable former.

The former may have two linear edges extending outwardly from each end respectively of the arcuate convex portion of the edge. At least a part of each linear edge is preferably provided on a portion of the former which is movable relative to the remaining portion of the former in the direction of extension of the linear edges so that at least the linear parts of the beam bent around the former may be stretched. Such stretching has been found to be particularly suitable for T-section beams and helps to prevent problems of spring-back with such beams.

It has been found that use of the method and apparatus of the invention results in efficient and economical production of metal arches suitable for use in the lining of mine tunnels.

The invention will now be further described by way of example with reference to the accompanying drawings in which.

Figure 1:
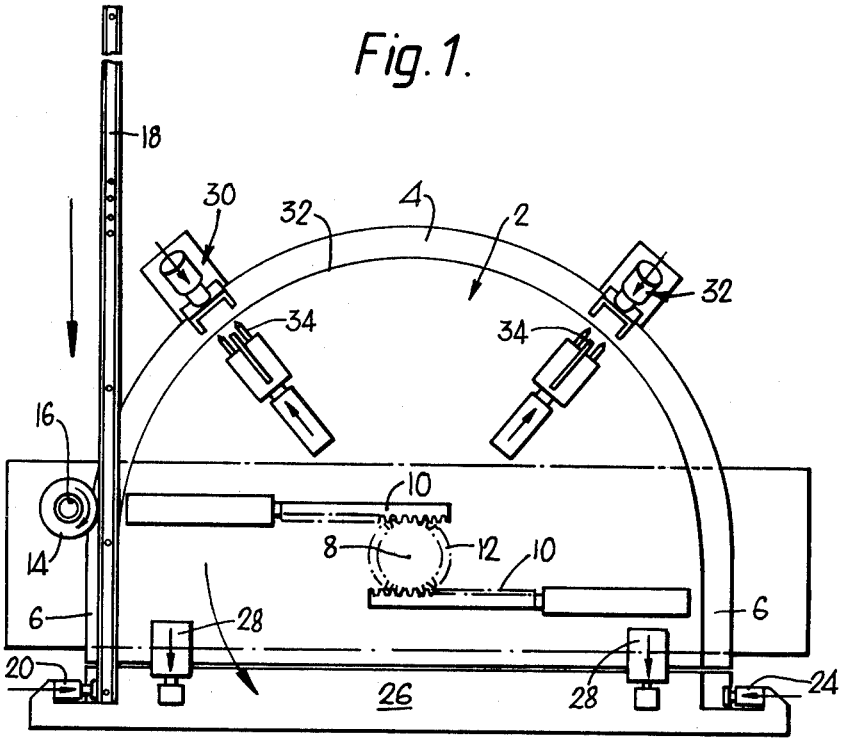
FIG. 1 is a sketch of one embodiment of bending apparatus in accordance with the invention showing a metal "H"-section beam clamped to one end of a rotatable former.
Figure 2:
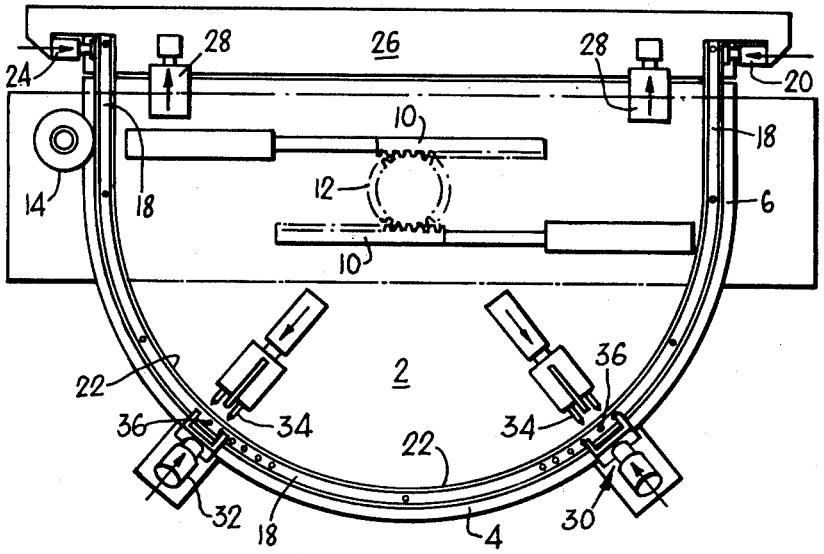
FIG. 2 is a view corresponding to FIG. 1 but showing the beam in its bent position around the former.

Referring to FIGS. 1 and 2, the apparatus comprises a D-shaped rotatable former or turntable generally indicated at 2 having a convex arcuate edge 4 and two linear ends 6, one extending from each end of the arcuate section. The turntable is rotatably mounted about an axis 8 at the centre of curvature of the arcuate section 4 and is rotatable by two oppositely directed hydraulically operated racks 10 engaging one or each side respectively of a spur gear 12.

A freely rotatable roller 14 is mounted on a spindle 16 to a fixed base of the apparatus. A linear length of an "H"-section metal beam 18 has one end secured to the turntable by means of a hydraulic clamp 20 as illustrated in FIG. 1. The beam extends over one linear end of the turntable between the turntable and the roller 14.

The former 2 is then rotated by means of the hydraulically operated racks 10 in an anti-clockwise direction as shown in FIG. 1 which causes the beam 18 by reason of its abutment both against the roller 16 and a shoulder 22 on the former 2 to be bent around the former as the former rotates.

When the former has been rotated through 180°, the position shown in FIG. 2 is reached in which the bending of the beam is completed and the other free end of the beam is then clamped, by means of a second hydraulic clamp 24, to the other end of the former.

The end portion 26 of the former carrying the ends of the longitudinal edge lengths, is mounted separately from the remainder of the former and can be moved relative thereto by means of hydraulic rams illustrated at 28. Operation of these rams to move the movable portion 26 away from the remainder of the former, causes at least the longitudinal portions of the beam 18 to be stretched to help to prevent spring-back. This stretching is normally employed with "T"-section beams but may of course be used for other sections if required.

When the beam is in the position shown in FIG. 2 (and stretched when necessary), the beam is cut into three separate sections by means of two saw devices indicated at 30, 32 located above the turntable but mounted for movement therewith, the beam being clamped by clamps (not shown) positioned below the beam and acting to hold the beam againt the arcuate edge of the former. The saws are aligned by means of a pin unit 34, the pins of which engage in holes 36 previously formed in the metal beam and which provide connecting holes for fish-plates or the like, to be used to couple cut lengths of the beam together to form an arch in a mine tunnel or the like.

When the saws have been operated the saw clamps and the clamps 20 and 24 may be released and the three bent sections of the beam removed.

The turntable is then driven back to the position shown in FIG. 1.

Figure 3:
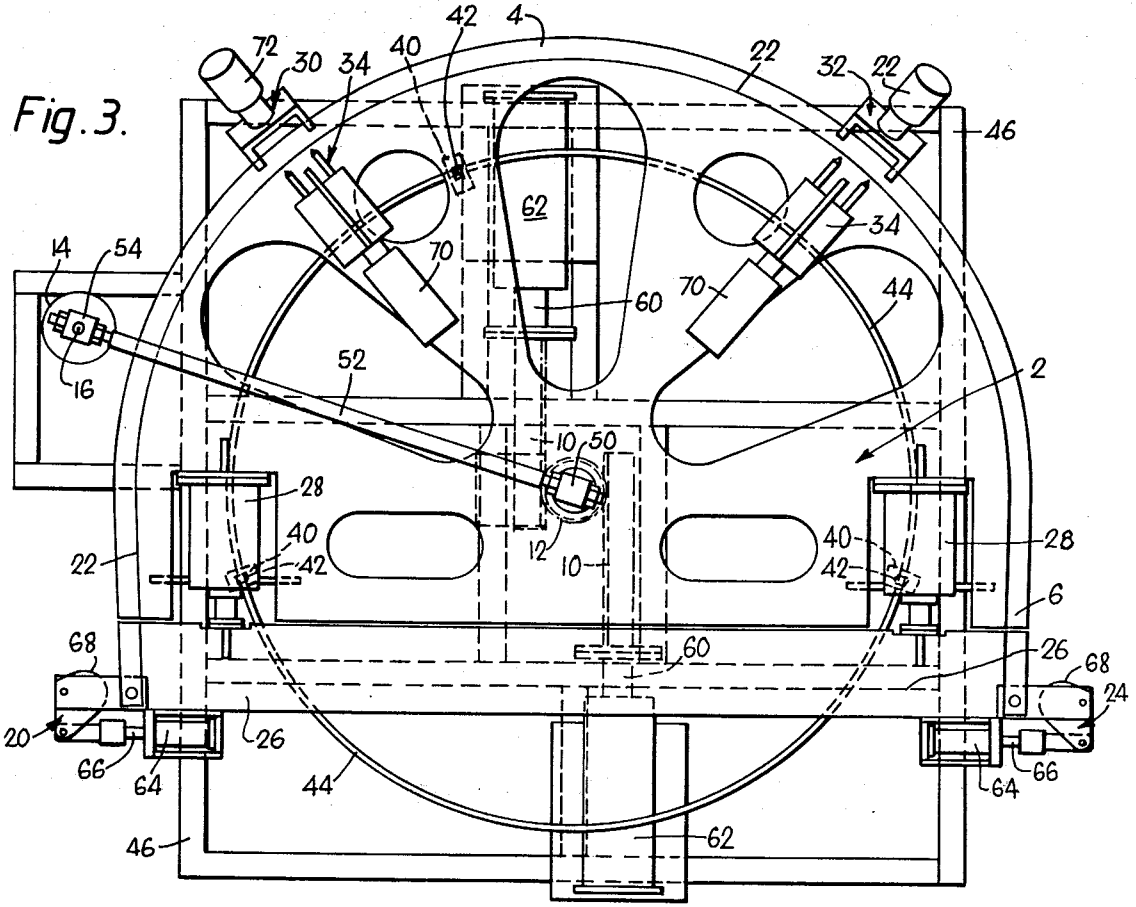
FIG. 3 is a more detailed plan view of one embodiment of the bending apparatus shown in sketch form in FIGS. 1 and 2.
Figure 4:
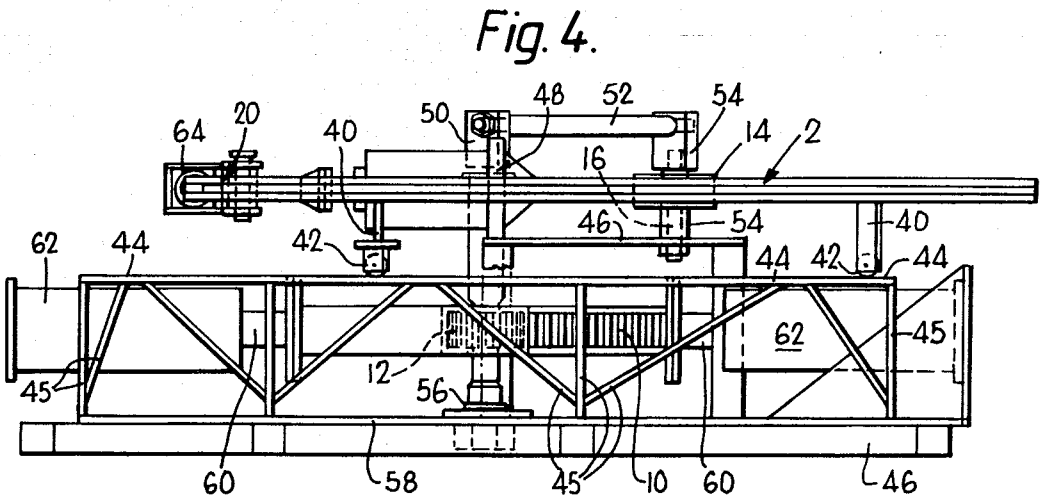
FIG. 4 is an end elevation corresponding to FIG. 3.

The parts of the apparatus described briefly with reference to FIGS. 1 and 2 may be seen in more detail and under the same reference numbers in FIGS. 3 and 4. Referring to these figures, the turntable 2 is provided with downwardly depending legs 40 ending in wheels 42 which run on a support ring 44 mounted by struts 45 on a base frame 46.

The spindle 48 of the turntable 2 is mounted in an upper bearing 50 positioned above the turntable 2 and carried by an arm 52 supported by a support member 54 on the frame 46. The spindle 48 carries the gear 12 which meshes with the drive racks 10. The racks 10 are themselves carried at the end of the pistons 60 of two oppositely directed hydraulic cylinders 62.

The hydraulic clamps 20, 24 at each end of the turntable edge each comprise a hydraulic cylinder 64, the piston 66 of which actuates a clamping cam member 68. The clamps are mounted on the movable end portion 26 of the turntable or former.

The saw clamps (not shown) are hydraulically operated and are positioned beneath the turntable. On actuation they clamp the bent beam against the arcuate edge of the former at each side of each saw.

The pins of the location pin devices 34 of the saw units 30, 32 are caused to engage in the respective holes of the beam by means of hydraulic cylinders 70, the saw itself being driven by a motor designated at 72.

The linear end portions of the former edge may converge slightly as compared with the parallel alignment shown in the drawings.

In use and if it is desired to stretch the bent beam, the rams 28 are actuated to cause the portion 26 of the former to move away from the remaining portion, the ends of the beam being clamped by clamps 20, 24.

Thereafter, the rams 20, 24 and 28 are deactuated so as to relieve the stress on the arched T-beam and enable it to be removed. Finally, the former is returned to its original position ready for repeating the process with another T or H-beam.

The spring-back in the released formed T or H-beam as well as any twisting therein is minimized by the stretching thereof and it has been found that the final form of the arched T or H-beam can be controlled within close tolerances by controlling the hydraulic pressures applied to the rams which take part in the clamping and the stretching of the T or H-beam.

Lugs, brackets, etc., may be welded to the T or H-beam for mounting panelling.

We claim:

1. A machine for forming a curved beam, said machine comprising a former having a convex arcuate edge bounded by opposed ends, a first clamp positioned to cooperate with one of said ends of said arcuate edge, said first clamp being adapted to hold one end of a beam in fixed position relative to said arcuate edge prior to and during the bending of that beam about said arcuate edge, a roller positioned adjacent to said arcuate edge but spaced therefrom a distance not significantly greater than the width of said beam, said roller being moveable relative to said former for bending said beam about said arcuate edge between a beam entry position at which said beam is initially clamped to said arcuate edge between said roller and said arcuate edge, and a curved beam position at which said beam is bent about said arcuate edge, motor means for moving said former relative to said roller for translating said beam between said entry and curved positions, and a second clamp positioned to cooperate with the opposite end of said arcuate edge, said second clamp being adapted to hold the other end of said beam in fixed position adjacent said opposite end of said arcuate edge after said beam has been bent about said arcuate edge, said second clamp being operatively connectable with the other end of said beam only after said beam has been bent about said arcuate edge.

2. A forming machine as set forth in claim 1, said machine further comprising an end portion connected with said former, said end portion being movable relative to said arcuate edge, said first and second clamps being mounted on said end portion, and motor means for moving said end portion in a direction away from said convex arcuate edge, said motor means being operable after said beam has been bent about said arcuate edge and when both of said beam's ends have been clamped by said first and second clamps, movement of said end portion away from said convex arcuate edge tending to stretch at least the end sections of said beam after said beam has been bent around said arcuate edge.

3. A forming machine as set forth in claim 2, said former comprising a linear edge extending outwardly from each of said arcuate edge, said linear edge cooperating with said arcuate edge to form said beam in generally D-shaped configuration.

4. A forming machine as set forth in claim 3, said arcuate edge being of a partially circular configuration, and one of said roller and said former being movable about an axis that constitutes the center of that arc defining said arcuate edge.

5. A forming machine as set forth in claim 4, said roller being a freely rotatable roller mounted on a fixed base, and said former being rotatable relative to said roller.

6. A forming machine as set forth in claim 5, said machine comprising a support ring immobily positioned on a base, and rollers connected to said former, said rollers running on said support ring as said former is moved between beam entry and curved beam positions.

7. A forming machine as set forth in claim 6, said former motor means comprising a spindle connected to said former, a spur gear mounted on said spindle, two racks cooperatively engaged with said spur gear on generally opposite sides thereof, and a motor connected with said racks, said motor and racks cooperating with said spur gear to rotate said former between beam entry and curved beam positions.

8. A forming machine as set forth in claim 2, said motors for rotating said former and for moving said former's end portion all comprising hydraulic rams.

9. A forming as set forth in claim 2, said machine comprising at least one cutting device positioned adjacent said arcuate edge of said former when said former is in the curved beam position, said cutting device being adapted to cut a bent beam into two or more arcuate sections when said former is in curved beam position and when the beam is bent around said arcuate edge.

10. A forming machine as set forth in claim 9, said cutting device being mounted in fixed position relative to said arcuate edge so that cutting device simultaneously moves between said beam entry and curved beam positions as said former moves between those same positions.

11. A forming machine as set forth in claim 9, said machine comprising an alignment device associated with each cutting device, said alignment device having at least one pin adapted to engage a pre-formed hole in a beam when said beam is bent around said arcuate edge, said pin being interconnectable with said beam for accurately positioning said cutting device relative to said beam when cutting of said beam into arcuate sections is desired.

12. A method of forming an arched beam from an elongate beam, said method comprising the steps of providing a former with an arcuate edge bounded by opposed ends, said former cooperating with a roller positioned adjacent that arcuate edge, said former being movable between beam entry and curved beam positions relative to said roller, clamping one end of said elongate beam to one of said ends of said arcuate edge of said former so that said beam can be formed against said arcuate edge through cooperation of said roller and said arcuate edge, moving said former relative to said roller so that said beam is caused by engagement between said roller and said former to be bent against said arcuate edge, and subsequently clamping the other end of said beam to the opposite end of said arcuate edge of said former after said beam has been bent around said arcuate edge, the other end of said beam being clamped to said former only after said beam bending step has been completed.

13. A forming method as set forth in claim 12, said method comprising the step of stretching at least the end sections of said beam after said beam has been bent and clamped at both ends.

14. A forming method as set forth in claim 13, said beam being bent into final position having a generally arcuate center section and a generally linear section at each end thereof, at least said linear sections being stretched longitudinally thereof during said stretching step.

15. A forming method as set forth in claim 13, said method comprising the further step of cutting said beam into at least two sections after said bent beam has been completely clamped and stretched.

16. A method as set forth in claim 15, said method comprising the step of aligning a cutting device with said beam by inserting at least one pin into a hole in said beam, said hole being pre-formed in said beam prior to said beam being bent about said arcuate edge.

17. A machine for forming and cutting a beam, said beam having at least one pre-formed hole therein at a location in said beam adjacent to where said beam is to be cut, said machine comprising a former having a convex arcuate edge, a roller positioned adjacent to said arcuate edge but spaced therefrom a distance not significantly greater than the width of said beam, said roller being moveable relative to said former for bending said beam about said arcuate edge into a curved beam configuration at which said beam is bent about said arcuate edge, motor means for moving said former relative to said roller for translating said beam between beam entry and curved beam positions, a first clamp and a second clamp positioned to cooperate with said arcuate edge, said first and second clamps being adapted to hold said beam in fixed position relative to said arcuate edge after said beam has been bent about said arcuate edge, at least one cutting device positioned adjacent said arcuate edge of said former when said former is in the curved beam position, said cutting device being adapted to cut a bent beam into two or more arcuate sections when said former is in the curved beam position and when said beam is bent around said arcuate edge, and at least one pin adapted to engage said beam's preformed hole, said pin being operative to maintain a desired alignment between said bent beam and said cutting device as said cutting device cuts said bent beam into arcuate sections.

18. A machine as set forth in claim 17, said alignment device comprising at least two pins adapted to engage at least two preformed holes in said beam, said pins being positioned on opposite sides of the cut to be made through said bent beam by said cutting device.

19. A machine as set forth in claim 17, said cutting device and said alignment device both being mounted in fixed position relative to said arcuate edge so that both said devices simultaneously move between said beam entry and curved beam positions as said former moves between those same positions.

20. A machine as set forth in claim 17, said machine further comprising:

a separately movable portion connected with said former, said separately movable portion being movable relative to said arcuate edge, said first and second clamps being mounted on said separately movable portion, and motor means for moving said separately movable portion in a direction away from said convex arcuate edge, said motor means being operable after said beam has been bent about said arcuate edge and when both of said beam's ends have been clamped by said first and second clamps, movement of said separately movable portion away from said convex arcuate edge tending to stretch at least the end sections of said beam after said beam has been bent around said arcuate edge.

21. A machine as set forth in claim 20, said first clamp being adapted to hold one end of said beam in fixed position relative to said arcuate edge prior to and during the bending of that beam about said arcuate edge, and said second clamp being adapted to hold the outer end of said beam in fixed position after said beam has been bent about said arcuate edge, said second clamp not being operatively connectable with the other end of said beam until after said beam has been bent about said arcuate edge.

* * * * *

UNITED STATES PATENT AND TRADEMARK OFFICE

CERTIFICATE OF CORRECTION

PATENT NO. : 4,391,115

DATED : July 5, 1983

INVENTOR(S) : Wm. Slattery et al

It is certified that error appears in the above-identified patent and that said Letters Patent is hereby corrected as shown below:

At column 6, line 61, "outer" should be --other--.

Signed and Sealed this

*Eleventh* Day of *October 1983*

[SEAL]

*Attest:*

GERALD J. MOSSINGHOFF

*Attesting Officer*

*Commissioner of Patents and Trademarks*